United States Patent [19]

Araki et al.

[11] Patent Number: 4,764,500

[45] Date of Patent: Aug. 16, 1988

[54] THERMOSENSITIVE RECORDING SHEET

[75] Inventors: Shingo Araki, Settsu; Ryugo Maeda, Kobe; Masaji Inagaki, Shiya; Teijiro Kitao, Tondabayashi; Shigeki Ueno, Nishinomiya, all of Japan

[73] Assignee: Dainippon Ink and Chemicals, Inc., Tokyo, Japan

[21] Appl. No.: 49,327

[22] Filed: May 13, 1987

[30] Foreign Application Priority Data

| | | | |
|---|---|---|---|
| May 16, 1986 | [JP] | Japan | 61-110693 |
| Sep. 19, 1986 | [JP] | Japan | 61-219134 |
| Nov. 27, 1986 | [JP] | Japan | 61-280658 |
| Apr. 6, 1987 | [JP] | Japan | 62-82942 |
| Apr. 6, 1987 | [JP] | Japan | 62-82943 |

[51] Int. Cl.[4] ..... B41M 5/18

[52] U.S. Cl. ..... 503/208; 427/150; 427/151; 428/913; 503/209; 503/225

[58] Field of Search ..... 427/150–152; 503/208, 209, 225; 428/913

[56] References Cited

FOREIGN PATENT DOCUMENTS

| | | | |
|---|---|---|---|
| 74762 | 3/1979 | Japan | 503/209 |
| 139740 | 5/1979 | Japan | 503/209 |
| 71191 | 4/1983 | Japan | 503/209 |
| 112689 | 3/1986 | Japan | 503/209 |
| 0112689 | 5/1986 | Japan | 503/209 |

*Primary Examiner*—Bruce H. Hess

*Attorney, Agent, or Firm*—Sherman and Shalloway

[57] ABSTRACT

A thermosensitive recording sheet having a coated film containing a color-forming lactone compound, an acidic substance and a sensitizer. The sensitizer is at least one aliphatic carboxylic acid ester represented by the formula wherein $R^1$ and $R^2$ are identical or different and each represents an alkyl group having 1 to 20 carbon atoms, a cycloalkyl group, an aryl group, a group of the formula $—C_nH_{2n}—Ar$ in which n is an integer of 1 to 8 and Ar is an aryl group, or a group of the formula $—C_nH_{2n}—CO—Ar$ in which n and Ar are as defined; $R^3$ represents a group of the formula $—C_nH_{2n}—$ in which n is as defined; $R^4$ and $R^5$ are identical or different and each represents an alkyl group having 1 to 20 carbon atoms, a cycloalkyl group, a group of the formula $—C_nH_{2n}—Ar$ in which n and Ar are as defined, or a group of the formula $—C_nH_{2n}—CO—Ar$ in which n and Ar are as defined; and $R^6$ represents an alkyl group having 2 to 6 carbon atoms and substituted by a halogen atom selected from chlorine, bromine and iodine atoms; with the proviso that the alkyl group having 1 to 20 carbon atoms for $R^1$, $R^2$, $R^4$ and $R^5$ may be substituted by a halogen atom, and the cycloalkyl group, the aryl group and Ar in $—C_nH_{2n}—Ar$ and $—C_nH_{2n}—CO—Ar$ may be substituted by an alkyl, cycloalkyl, aryl, aralkyl, phenacyl, alkyloxy, aryloxy, aralkyloxy, arylcarbonyl, arylsulfonyl, nitro or ammoniumsulfonic acid group or a halogen atom.

16 Claims, No Drawings

THERMOSENSITIVE RECORDING SHEET

This invention relates to a thermosensitive recording sheet, and more specifically, to a thermosensitive recording sheet having a coated film containing a color-forming lactone compound, an acidic substance and a specific aliphatic carboxylic acid ester as a sensitizer.

Thermosensitive recording sheets are designed to display images such as characters and geometric figures by thermal energy, and have recently found applications in various printer recorders, facsimiles, POS labels and automatic ticket examination. There are various methods of thermosensitive recording. From the viewpoint of the clearness, resolution and color of images, the most prevalent method is to use a color-forming lactone compound such as Crystal Violet Lactone which is a dye precursor and an acidic substance capable of causing the lactone compound to form a color. In this method, a phenolic compound such as bisphenol A which is solid at room temperature but upon heating, is melted and acts as an acid component has previously been used as the acidic substance. Thermosensitive recording sheets used in this case are required to have a high degree of whiteness and excellent stability in the colored portion and the non-colored portion. Usually, to obtain a brilliant color, the sheets must be maintained at a temperature of about 140° to 150° C. for a period of time above a certain limit. Hence, various approaches have been made in order to obtain brilliant colors more rapidly and more easily. For example, there are a method in which stearamide is added as a sensitizer (Japanese Laid-Open Patent Publication No. 139740/1979), and a method in which benzyl p-hydroxybenzoate is used as the acidic substance (Japanese Laid-Open Patent Publication No. 74762/1979). The methods described in these patent documents are still not entirely satisfactory although they can increase color forming sensitivity. There is also a method in which an aryl ester derivative of an aliphatic mono- or di-basic acid having a melting point of 40° to 150° C. is added as the sensitizer (Japanese Laid-Open Patent Publication No. 71191/1983). The method described in this patent document can fully increase color forming sensitivity, but is not satisfactory with regard to the stability of the colored portion and the non-colored portion.

Extensive investigations of the present inventors undertaken with the foregoing background have now led to the discovery that the use of a specific aliphatic carboxylic acid ester as a sensitizer can give a thermosensitive recording sheet having a much higher effect of increasing color forming sensitivity than in the case of using conventional sensitizers, and has excellent stability in the colored portion and the non-colored portion.

According to this invention, there is provided a thermosensitive recording sheet having a coated film containing a color-forming lactone compound, an acidic substance and a sensitizer, said sensitizer being at least one aliphatic carboxylic acid ester represented by the formula

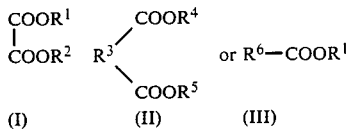

wherein $R^1$ and $R^2$ are identical or different and each represents an alkyl group having 1 to 20 carbon atoms, a cycloalkyl group, an aryl group, a group of the formula $—C_nH_{2n}—Ar$ in which n is an integer of 1 to 8 and Ar is an aryl group, or a group of the formula $—C_nH_{2n}—CO—Ar$ in which n and Ar are as defined; $R^3$ represents a group of the formula $—C_nH_{2n}—$ in which n is as defined; $R^4$ and $R^5$ are identical or different and each represents an alkyl group having 1 to 20 carbon atoms, a cycloalkyl group, a group of the formula $—C_nH_{2n}—Ar$ in which n and Ar are as defined, or a group of the formula $—C_nH_{2n}—CO—Ar$ in which n and Ar are as defined; and $R^6$ represents an alkyl group having 2 to 6 carbon atoms and substituted by a halogen atom selected from clorine, bromine and iodine atoms; with the proviso that the alkyl group having 1 to 20 carbon atoms for $R^1$, $R^2$, $R^4$ and $R^5$ may be substituted by a halogen atom, and the cycloalkyl group, the aryl group and Ar in $—C_nH_{2n}—Ar$ and $—C_nH_{2n}—CO—Ar$ may be substituted by an alkyl, cycloalkyl, aryl, aralkyl, phenacyl, alkyloxy, aryloxy, aralkyloxy, arylcarbonyl, arylsulfonyl, nitro or ammoniumsulfonic acid group or a halogen atom.

A preferred group of aliphatic carboxylic acid esters among the above compounds have a melting point of 60° to 150° C. and are represented by the following general formula

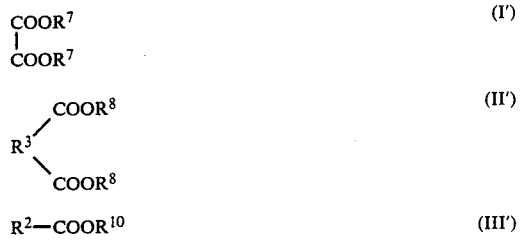

wherein $R^7$ represents a cycloalkyl group, an aryl group, a group of the formula $—C_nH_{2n}—Ar$ in which n is an integer of 1 to 8 and Ar is an aryl group; $R^3$ represents a group of the formula $—C_nH_{2n}—$ in which n is as defined; $R^8$ represents a cycloalkyl group, a group of the formula $—C_nH_{2n}—Ar$ in which n and Ar are as defined, or a group of the formula $—C_nH_{2n}—CO—Ar$ in which n and Ar are as defined; $R^9$ represents an alkyl group having 2 to 6 carbon atoms and substituted by a chlorine or bromine atom; and $R^{10}$ represents an aryl group; with the proviso that the cycloalkyl group, the aryl group, and Ar in $—C_nH_{2n}—Ar$ and $—C_nH_{2n}—CO—Ar$ may be substituted by an alkyl, cycloalkyl, aryl, aralkyl, phenacyl, alkyloxy, aryloxy, aralkyloxy, arylcarbonyl, arylsulfonyl, nitro or ammoniumsulfonic acid group, or a halogen atom.

Specific examples include aliphatic carboxylic acid esters of the following structural formulae (1) to (30). Of these, the aliphatic carboxylic acid esters of structural formulae (3) to (5), (9), (11) to (14), (19) and (21) to (25) are preferred.

(1)
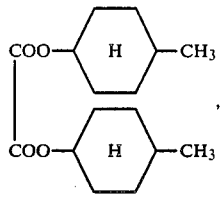
(2)
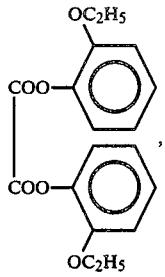
(3)
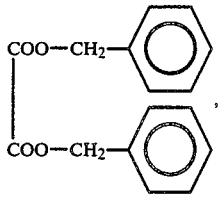
(4)
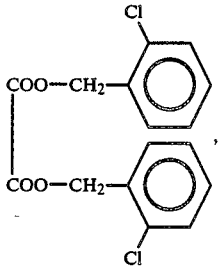
(5)
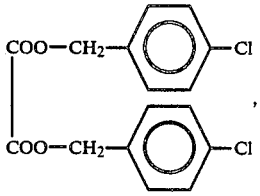
(6)
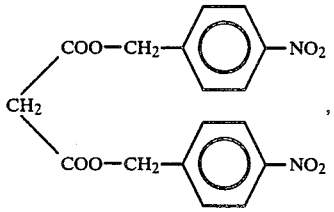
(7)
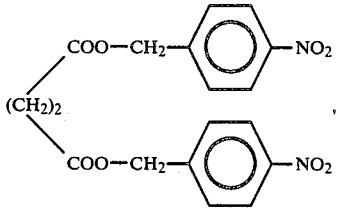
-continued
(8)
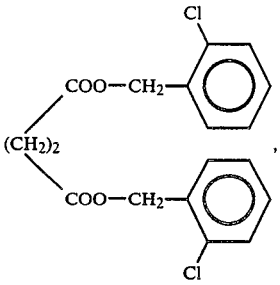
(9)
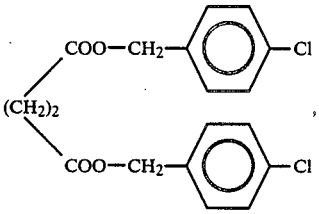
(10)
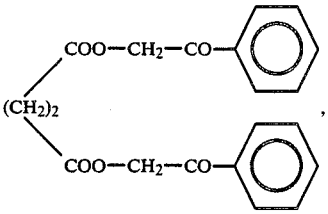
(11)
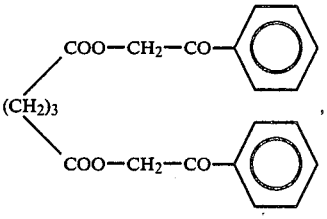
(12)
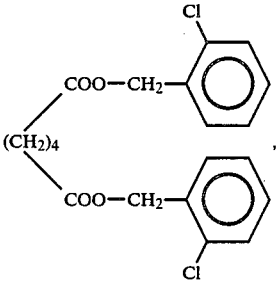
(13)
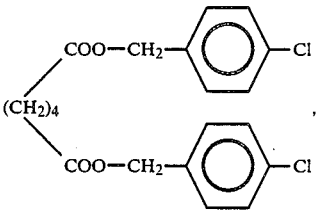

-continued
(14)
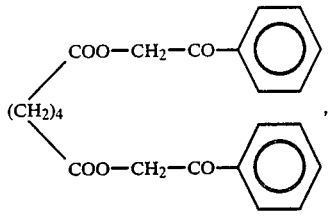
(15)
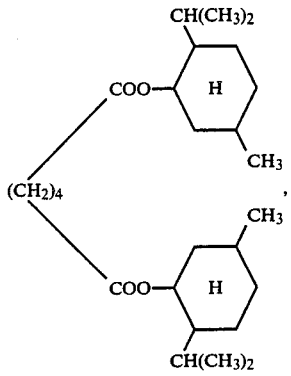
(16)
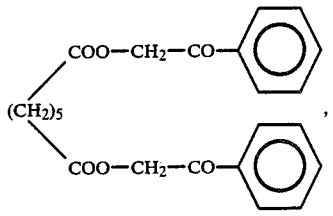
(17)
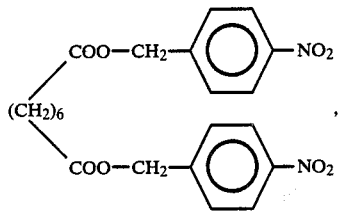
(18)
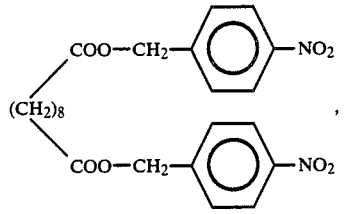
(19)
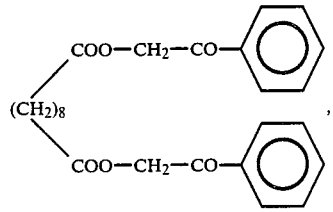
-continued
(20)
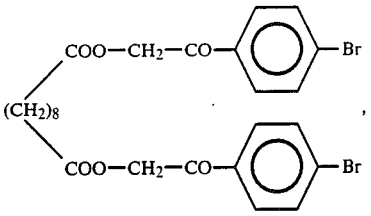
(21)
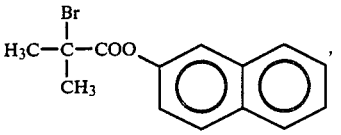
(22)
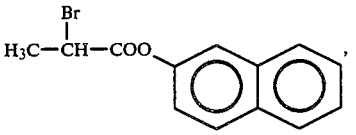
(23)
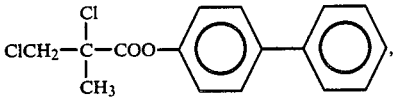
(24)
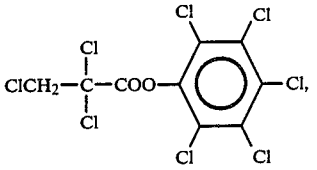
(25)
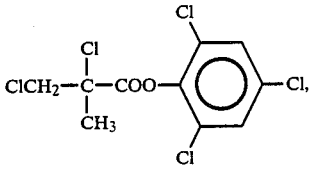
(26)
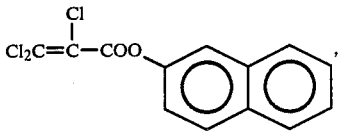
(27)
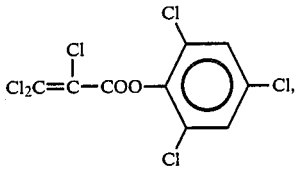
(28)
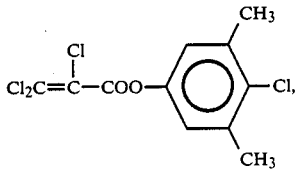
(29)
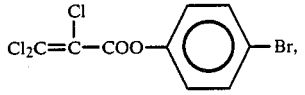

-continued

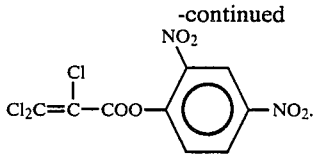

(30)

Examples of the color-forming lactone compound used in this invention include fluoranphthalides such as 3,3-bis(p-dimethylaminophenyl)phthalide, 3,3-bis(p-dimethylaminophenyl)-6-dimethylaminophthalide (also known as Crystal Violet Lactone; CVL for short), 3,3-bis(p-dimethylaminophenyl)-6-aminophthalide, 3,3-bis(p-dimethylaminophenyl)-6-nitrophthalide, 3,3-bis(p-dimethylaminophenyl)phthalide, 3,3-bis-3-dimethylamino-7-methylfluoran, 3-diethylamino-7-chlorofluoran, 3-diethylamino-6-chloro-7-methylfluoran, 3-diethylamino-7-anilinofluoran, 3-diethylamino-6-methyl-7-anilinofluoran, 3-piperidino-6-methyl-7-anilinofluoran, 3-(N-ethyl-p-toluidino)-7-(N-methylanilino)-fluoran, 3-(N-ethyl-p-tolidino)-6-methyl-7-anilinofluoran, 3-N-ethyl-N-isoamylamino-6-methyl-7-anilinofluoran, 3-N-methyl-N-cyclohexylamino-6-methyl-7-anilinofluoran and 3-N,N-diethylamino-7-o-chloroanilinofluoran; lactams such as Rhodamin B lactam; and spiropyrans such as 3-methylspirodinaphtopyran, 3-ethylspirodinaphthopyran and 3-benzylspironaphthopyran. These compounds should be colorless or pale-colored nd react with acidic substances to form colors.

The acidic substances used in this invention may be any acidic substrance which is solid at room temperature and when heated to about 60° to 180° C., is melted and opens the lactone ring of the color-forming lactone compound. It functions well in the presence of sensitizers. Examples of the acidic substance include 4-phenylphenol, 4-hydroxyacetophenone, 2,2'-dihydroxydiphenyl, 2,2'-methylenebis(4-chlorophenol), 2,2'-methylenebis(4-methyl-6-t-butylphenol), 4,4'-isopropylidenediphenol (also known as bisphenol A), 4,4'-isopropylidenebis(2-chlorophenol), 4,4'-isopropylidenebis(2-methylphenol), 4,4'-ethylenebis(2-methylphenol), 4,4'-thiobis(6-t-butyl-3-methylphenol), 1,1-bis(4-hydroxyphenyl)-cyclohexane, 2,2'-bis(4-hydroxyphenyl)-n-heptane, 4,4'-cyclohexylidene-bis(2-isopropylphenol), 4,4'-sulfonyldiphenol, salicylanilide, novolak-type phenolic resin and benzyl p-hydroxybenzoate.

The acidic substance is used in an amount of usually 10 to 1,000 parts by weight (all parts hereinafter are by weight), preferably 100 to 500 parts, per 100 parts of the color-forming lactone compound.

The sensitizer is used in an amount of usually 1 to 1,000 parts, preferably 30 to 100 parts, per 100 parts of the acidic substance.

The color forming lactone compound, the acidic substance and the sensitizer are used in the form of fine particles, preferably fine particles having a particle diameters of less than several microns.

Various known methods can be used to produce the thermosensitive recording sheet. Usually, there may be used (1) a method which comprises preparing a coating dispersion of the color forming lactone compound, the acidic substance and the sensitizer in water, and coating the coating dispersion on a sheet substrate, and (2) a method which comprises dispersing the color-forming lactone compound and the acidic substance separately in water, including the sensitizer into at least one of the aqueous coating dispersions, and coating the coating dispersions in superimposed relation on a sheet substrate. An aqueous binder should be added to the coating dispersions. Examples of the binder are polyvinyl alcohol, methyl cellulose, hydroxyethyl cellulose, carboxymethyl cellulose, starches, and styrene/maleic acid copolymer. Besides, ultraviolet absorbers (for example, benzophenone compounds and triazole compounds) fillers such as calcium carbonate, lubricants such as polyethylene wax and paraffin wax, agents for imparting water resistance, and other various chemicals may be added to the coating dispersions in order to improve their performance. Various dispersing agents for dispersing the various chemicals in the above coating dispersions may also be added.

The coating dispersion is coated on a sheet substrate so that its dry weight becomes generally 2 to 12 g per $m^2$ of the sheet substrate, and then dried at room temperature to about 50° C. to give the thermosensitive recrding sheet of the invention.

Paper is generally used as the sheet substrate, but plastic sheets and nonwoven sheets may also be used.

The thermosensitive recording sheet of this invention has very high color forming sensitivity and its colored and non-colored portions have excellent stability.

The following Examples, Comparative Examples and Test Example illustrate the present invention more specifically. It should be understood that the invention is not limited at all by these examples. All parts and percentages in these examples are by weight.

EXAMPLE 1

| | |
|---|---|
| Dispersion A (containing a dye) | |
| 3-(N—ethyl-p-toluidino)-6-methyl-7-anilinofluoran | 1.0 part |
| Aliphatic carboxylic acid ester of formula (1) | 2.0 parts |
| 10% Aqueous solution of polyvinyl alcohol | 3.0 parts |
| Water | 5.0 parts |
| Total | 11.0 parts |
| Dispersion B (containing an acidic substance) | |
| bisphenol A | 3.0 parts |
| Calcium carbonate | 3.0 parts |
| Zinc stearate | 0.5 part |
| 10% Aqueous solution of polyvinyl alcohol | 7.0 parts |
| Water | 10.0 parts |
| Total | 23.5 parts |

Dispersions A and B were separately prepared by mixing the indicated ingredients and pulverizing and dispersing them by a paint conditioner. Then, 11.0 parts of dispersion A and 23.5 parts of dispersion B were mixed to form a thermosensitive coating dispersion. It was coated on high-quality paper at a rate of 64.5 g/$m^2$ so that its amount upon drying became 8 g/$m^2$, and then dried to obtain a thermosensitive recording sheet in accordance with this invention.

This sheet had excellent color forming sensitivity and excellent stability at the colored and non-colored portions.

EXAMPLES 2-30

Thermosensitive recording sheets in accordance with this invention were prepared in the same way as in Example 1 except that the aliphatic carboxylic acid esters of formulae (2) to (30) were used instead of the aliphatic carboxylic acid ester of formula (1).

These sheets had excellent color-forming sensitivity and excellent stability at the colored and non-colored portions.

EXAMPLE 31

A thermosensitive recording sheet in accordance with this invention was prepared in the same way as in Example 3 except that the amount of the aliphatic carboxylic acid ester of formula (3) added was changed to 1.0 part and the amount of dispersion A was changed to 10 parts.

The sheet had excellent color forming sensitivity and excellent stability at the colored and non-colored portions.

EXAMPLE 32

A thermosensitive recording sheet in accordance with this invention was prepared in the same way as in Example 3 except that the amount of the aliphatic carboxylic acid ester of formula (3) added was changed to 4.0 parts and the amount of dispersion A was changed to 13 parts.

The sheet had excellent color forming sensitivity and excellent stability at the colored and non-colored portions.

COMPARATIVE EXAMPLE 1

A thermosensitive recording sheet for comparison was prepared in the same way as in Example 1 except that the aliphatic carboxylic acid ester of formula (1) was not added, and the amount of dispersion A used was changed to 9.0 parts.

The sheet had inferior color-forming sensitivity.

COMPARATIVE EXAMPLE 2

A thermosensitive recording sheet for comparison was prepared in the same way as in Example 1 except that stearamide was used instead of the aliphatic carboxylic acid ester of formula (1).

The sheet had inferior color-forming sensitivity and stability at the colored and non-colored portions.

COMPARATIVE EXAMPLE 3

A thermosensitive recording sheet for comparison was prepared except that the addition of the aliphatic carboxylic acid ester of formula (1) was omitted, the amount of dispersion A was changed to 9 parts, and benzyl p-hydroxybenzoate was used instead of bisphenol A.

The sheet had inferior color-forming sensitivity and inferior stability at the colored portion.

COMPARATIVE EXAMPLE 4

A thermosensitive recording sheet for comparison was prepared in the same way as in Example 1 except that bis(p-benzylphenol)malonate was used instead of the aliphatic carboxylic acid ester of formula (1).

This sheet has inferior long-term stability at the colored and non-colored portions.

COMPARATIVE EXAMPLE 5

A thermosensitive recording sheet for comparison was prepared in the same way as in Example 1 except that di-m-tolyl adipate was used instead of the aliphatic carboxylic acid ester of formula (1).

This sheet has inferior long-term stability at the colored and non-colored portions.

COMPARATIVE EXAMPLE 6

A thermosensitive recording sheet for comparison was prepared in the same way as in Example 1 except that diphenyl sebacate was used instead of the aliphatic carboxylic acid ester of formula (1).

This sheet has inferior long-term stability at the colored and non-colored portions.

TEST EXAMPLE

The thermosensitive recording sheets obtained in Examples 1 to 32 and Comparative Example 1 to 6 were tested for dynamic image density, and the stability of the colored and non-colored portions by methods described below. The results are shown in Tables 1 and 2.

Measurement of the dynamic image density

An image was printed on the thermosensitive recording sheet by means of a thermal head printing device (Model MSI, made by Matsushita Electronic Components Co., Ltd.) with a pulse width of 0.5 millisecond, and the density of the image was measured by a Macbeth densitometer (RD-918, made by Macbeth Co., U.S.A.).

Evaluation (A) of the stability of the colored and non-colored portions

The sheet was pressed against a hot plate at 140° C. under a pressure of 2.0 kg/cm$^2$ for 1 second. The colored portion and the remaining non-colored portion were left to stand at 40° C. and 90% RH for 24 hours. The degree of whitening or background fog of the colored and non-colored portions was visually observed and evaluated on the following scale.

(1) Scale of evaluation of the colored portion
◎: No whitening
○: Hardly any whitening
Δ: Whitening occurred
X: Marked whitening
(2) Scale of evaluation of the non-colored portion
◎: No background fog
○: Hardly any background fog
Δ: Background fog occurred
X: Marked background fog

Evaluation (B) of the stability of the colored and non-colored portions

Evaluated by the same procedure as in evaluation (A) except that the colored and non-colored portions were left to stand for three months at 50° C. and 55% RH.

TABLE 1

| Example | Dynamic image density | Stability evaluation (A) Colored portion | Stability evaluation (A) Non-colored portion | Stability evaluation (B) Colored portion | Stability evaluation (B) Non-colored portion |
|---|---|---|---|---|---|
| 1 | 1.08 | ◎ | ◎ | ○ | ◎ |
| 2 | 1.06 | ◎ | ◎ | ◎ | ○ |
| 3 | 1.12 | ◎ | ◎ | ◎ | ◎ |
| 4 | 1.13 | ◎ | ◎ | ◎ | ◎ |
| 5 | 1.13 | ◎ | ◎ | ◎ | ◎ |
| 6 | 1.09 | ◎ | ◎ | ○ | ◎ |
| 7 | 1.08 | ◎ | ◎ | ◎ | ◎ |
| 8 | 1.09 | ◎ | ◎ | ◎ | ○ |
| 9 | 1.12 | ◎ | ◎ | ◎ | ◎ |
| 10 | 1.08 | ◎ | ◎ | ◎ | ◎ |
| 11 | 1.12 | ◎ | ◎ | ◎ | ◎ |
| 12 | 1.15 | ◎ | ◎ | ◎ | ◎ |

TABLE 1-continued

| Example | Dynamic image density | Stability evaluation (A) Colored portion | Stability evaluation (A) Non-colored portion | Stability evaluation (B) Colored portion | Stability evaluation (B) Non-colored portion |
|---|---|---|---|---|---|
| 13 | 1.14 | ◎ | ◎ | ◎ | ◎ |
| 14 | 1.13 | ◎ | ◎ | ◎ | ◎ |
| 15 | 1.08 | ◎ | ◎ | ◎ | ○ |
| 16 | 1.09 | ◎ | ◎ | ◎ | ○ |
| 17 | 1.08 | ◎ | ◎ | ○ | ◎ |
| 18 | 1.09 | ◎ | ◎ | ◎ | ○ |
| 19 | 1.13 | ◎ | ◎ | ◎ | ◎ |
| 20 | 1.08 | ◎ | ◎ | ○ | ◎ |

TABLE 2

| | Dynamic image density | Stability evaluation (A) Colored portion | Stability evaluation (A) Non-colored portion | Stability evaluation (B) Colored portion | Stability evaluation (B) Non-colored portion |
|---|---|---|---|---|---|
| Example 21 | 1.15 | ◎ | ◎ | ◎ | ◎ |
| Example 22 | 1.20 | ◎ | ◎ | ◎ | ◎ |
| Example 23 | 1.18 | ◎ | ◎ | ◎ | ◎ |
| Example 24 | 1.22 | ◎ | ◎ | ◎ | ◎ |
| Example 25 | 1.20 | ◎ | ◎ | ◎ | ◎ |
| Example 26 | 1.10 | ◎ | ○ | ◎ | ○ |
| Example 27 | 1.02 | ◎ | ◎ | ◎ | ◎ |
| Example 28 | 1.05 | ◎ | ◎ | ◎ | ◎ |
| Example 29 | 1.14 | ◎ | ○ | ◎ | ○ |
| Example 30 | 1.02 | ◎ | ○ | ◎ | ○ |
| Example 31 | 1.08 | ◎ | ◎ | ◎ | ◎ |
| Example 32 | 1.13 | ◎ | ○ | ◎ | ○ |
| Comparative Example 1 | 0.53 | ○ | ◎ | ○ | ◎ |
| Comparative Example 2 | 0.73 | X | Δ | X | Δ |
| Comparative Example 3 | 0.63 | X | ○ | X | ○ |
| Comparative Example 4 | 1.15 | ◎ | ◎ | Δ | Δ |
| Comparative Example 5 | 1.07 | ◎ | ◎ | Δ | Δ |
| Comparative Example 6 | 1.08 | ◎ | ◎ | Δ | X |

What is claimed is:

1. A thermosensitive recording sheet having a coated film containing a color-forming lactone compound, an acidic substance and a sensitizer, said sensitizer being at least one aliphatic carboxylic acid ester represented by the formula

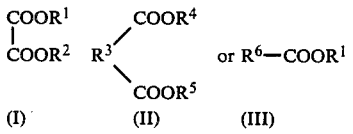

(I) (II) (III)

wherein $R^1$ and $R^2$ are identical or different and each represents an alkyl group having 1 to 20 carbon atoms, a cycloalkyl group, an aryl group, a group of the formula $—C_nH_{2n}—Ar$ in which n is an integer of 1 to 8 and Ar is an aryl group, or a group of the formula $—C_nH_{2n}—CO—Ar$ in which n and Ar are as defined; $R^3$ represents a group of the formula $—C_nH_{2n}—$ in which n is as defined; $R^4$ and $R^5$ are identical or different and each represents an alkyl group having 1 to 20 carbon atoms, a cycloalkyl group, a group of the formula $—C_nH_{2n}—Ar$ in which n and Ar are as defined, or a group of the formula $—C_nH_{2n}—CO—Ar$ in which n and Ar are as defined; and $R^6$ represents an alkyl group having 2 to 6 carbon atoms and substituted by a halogen atom selected from chlorine, bromine and iodine atoms; with the proviso that the alkyl group having 1 to 20 carbon atoms for $R^1$, $R^2$, $R^4$ and $R^5$ may be substituted by a halogen atom, and the cycloalkyl group, the aryl group and Ar in $—C_nH_{2n}—Ar$ and $—C_nH_{2n}—CO—Ar$ may be substituted by an alkyl, cycloalkyl, aryl, aralkyl, phenacyl, alkyloxy, aryloxy, aralkyloxy, arylcarbonyl, arylsulfonyl, nitro or ammoniumsulfonic acid group or a halogen atom.

2. The thermosensitive recording sheet of claim 1 wherein the sensitizer is at least one oxalic ester having a melting point of 60° to 150° C. and represented by the general formula (I')

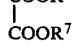

(I')

wherein $R^7$ represents a cycloalkyl group, an aryl group, a group of the formula $—C_nH_{2n}—Ar$ in which n is an integer of 1 to 8 and Ar is an aryl group, with the proviso that the cycloalkyl group, the aryl group, and Ar in $—C_nH_{2n}—Ar$ may be substituted by an alkyl, cycloalkyl, aryl, aralkyl, phenacyl, alkyloxy, aryloxy, aralkyloxy, arylcarbonyl, arylsulfonyl, nitro or ammonium sulfonic acid group, or a halogen atom.

3. The thermosentive recording sheet of claim 1 wherein the sensitizer is at least one dibasic acid ester having a melting point of 60° to 150° C. and represented by the following general formula (II')

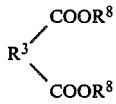

(II')

wherein $R^3$ represents a group of the formula $—C_nH_{2n}—$ in which n is an integer of 1 to 8; $R^8$ represents a cycloalkyl group, a group of the formula $—C_nH_{2n}—Ar$ in which n is as defined and AR is an aryl group, or a group of the formula $—C_nH_{2n}—CO—Ar$ in which n and Ar are as defined; with the proviso that the cycloalkyl group, and Ar in $—C_nH_{2n}—Ar$ and $—C_nH_{2n}—CO—Ar$ may be substituted by an alkyl, cycloalkyl, aryl, aralkyl, phenacyl, alkyloxy, aryloxy, aralkyloxy, arylcarbonyl, arylsulfonyl, nitro or ammonium sulfonic acid group, or a halogen atom.

4. The thermosensitive recording sheet of claim 1 whrein the sensitizer is at least one aliphatic monocarboxylic acid ester having a melting point of 60° to 150° C. and represented by the general formula (III')

$$R^9—COOR^{10} \qquad (III')$$

wherein $R^9$ represents an alkyl group having 2 to 6 carbon atoms and substituted by a chlorine or bromine atom; $R^{10}$ represents an aryl group which may be substituted by an alkyl, cycloalkyl, aryl, aralkyl, phenacyl, alkyloxy, aryloxy, aralkyloxy, arylcarbonyl, arylsulfonyl, nitro or ammonium sulfonic acid group, or a halogen atom.

5. The thermosensitive recording sheet of claim 1 wherein the sensitizer is at least one oxalic ester represented by the structural formula (1)
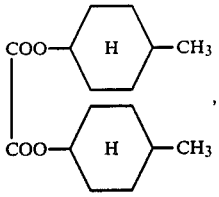
(2)
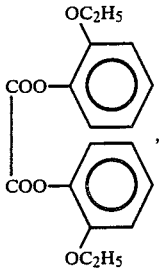
(3)
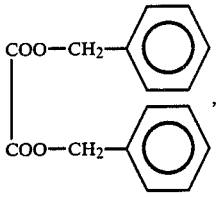
(4)
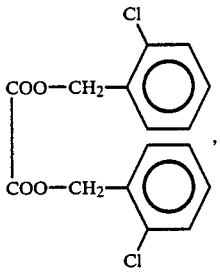
, or
(5)
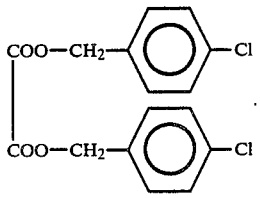
6. The thermosensitive recording sheet of claim 1 wherein the sensitizer is at least one dibasic acid ester represented by the formula
(6)
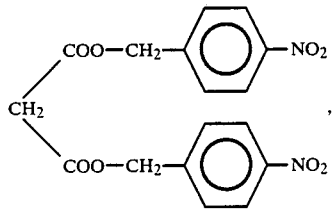
-continued
(7)
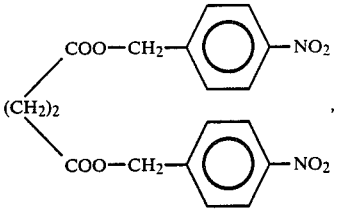
(8)
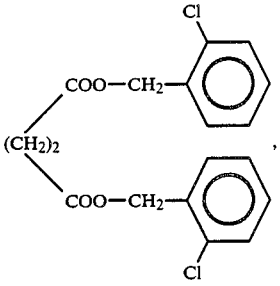
(9)
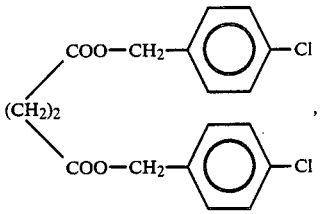
(10)
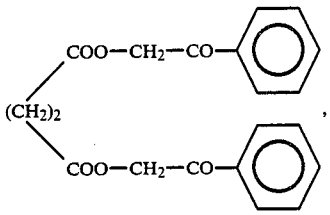
(11)
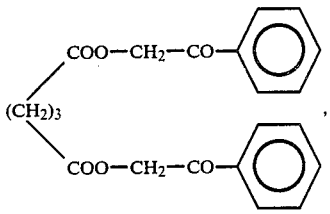
(12)
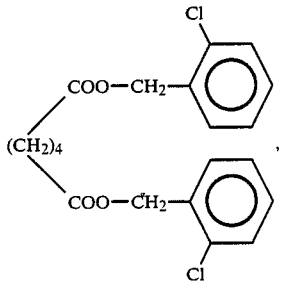

-continued
(13)
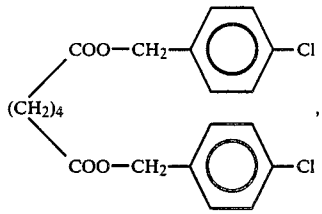
(14)
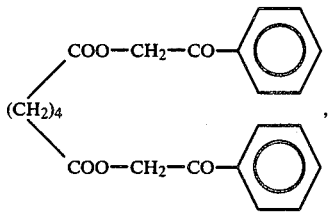
(15)
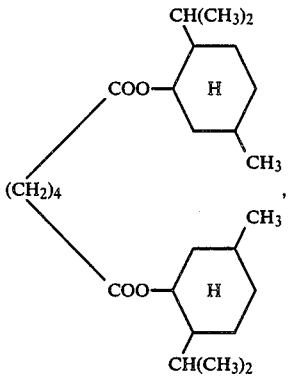
(16)
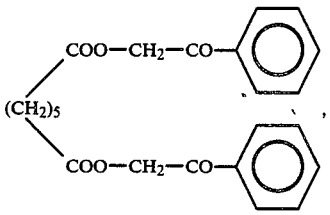
(17)
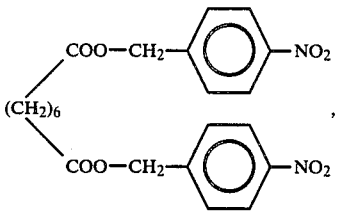
(18)
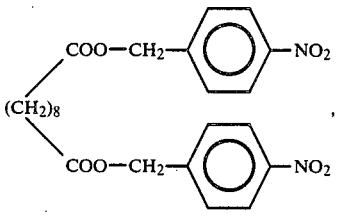
-continued
(19)
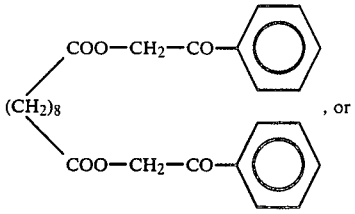
(20)
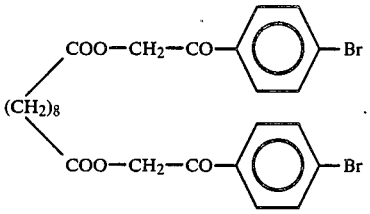
7. The thermosensitive recording sheet of claim 1 wherein the sensitizer is at least one aliphatic monocarboxylic acid ester represented by the structural formula
(21)
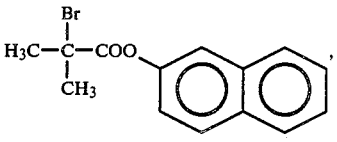
(22)
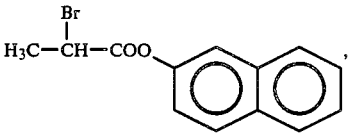
(23)
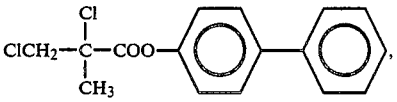
(24)
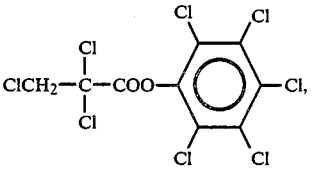
(25)
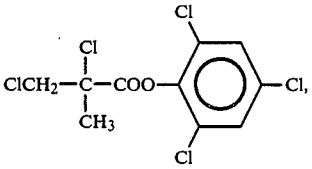
(26)
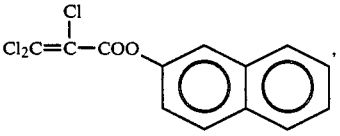

-continued (27)

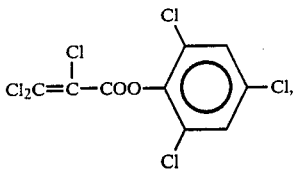

(28)

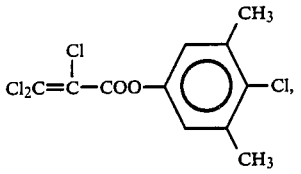

(29)

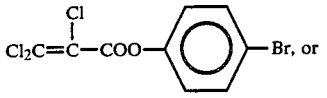

(30)

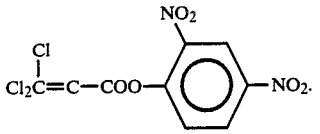

8. The thermosensitive recording sheet of claim 1 wherein the sensitizer is at least one oxalic ester represented by the structural formula (3)

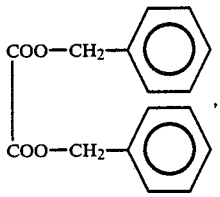

(4)

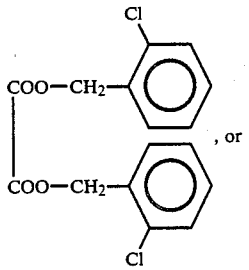

(5)

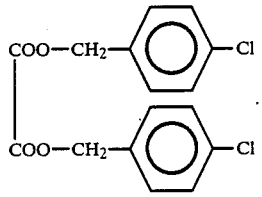

9. The thermosensitive recording sheet of claim 2, 5 or 8 wherein the amount of the sensitizer in the coated film is 30 to 100 parts by weight per 100 parts by weight of the acidic substance.

10. The thermosensitive recording sheet of claim 1 wherein the sensitizer is at least one dibasic acid ester represented by the structural formula (9)

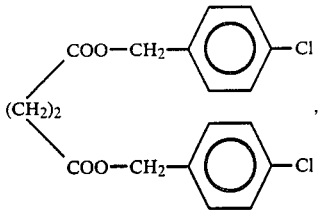

(11)

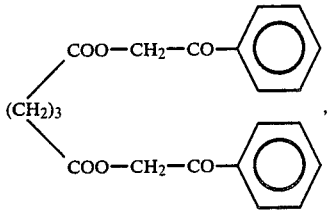

(12)

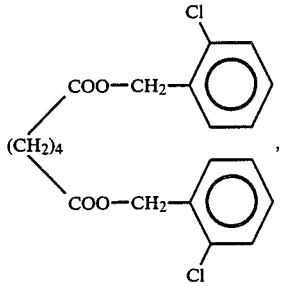

(13)

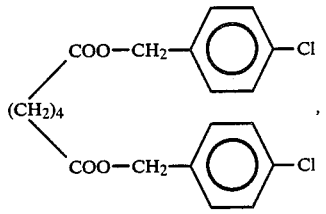

(14)

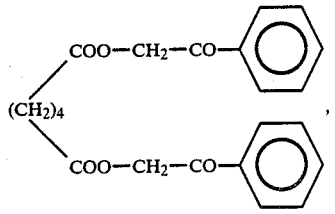

(19)

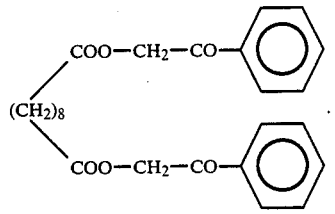

11. The thermosensitive sheet of claim 3, 6 or 10 wherein the amount of the sensitizer in the coated film is 30 to 100 parts by weight per 100 parts by weight of the acidic substance.

12. The thermosensitive recording sheet of claim 1 wherein the sensitizer is at least one aliphatic monocarboxylic acid ester represented by the structural formula (21)

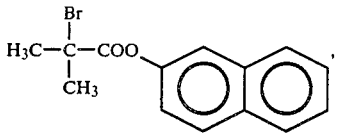

(22)

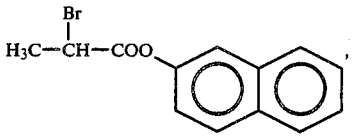

(23)

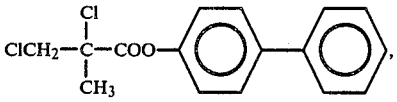

(24)

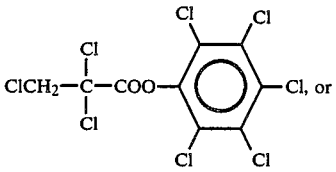

-continued (25)

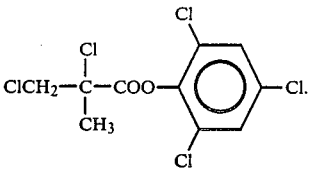

13. The thermosensitive recording sheet of claim 4, 7 or 12 wherein the amount of the sensitizer in the coated film is 30 to 100 parts by weight per 100 parts by weight of the acidic substance.

14. The thermosensitive recording sheet of claim 1 wherein the amount of the acidic substance in the coated film is 100 to 500 parts by weight per 100 parts by weight of the color-forming lactone compound.

15. The thermosensitive recording sheet of claim 1 wherein the amount of the sensitizer in the coated film is 1 to 1,000 parts by weight per 100 parts by weight of the acidic substance.

16. The thermosensitive recording sheet of claim 1 wherein the amount of the sensitizer in the coated film is 30 to 100 parts by weight per 100 parts by weight of the acidic substance.

* * * * *